US007140317B2

(12) United States Patent
Wybro et al.

(10) Patent No.: US 7,140,317 B2
(45) Date of Patent: Nov. 28, 2006

(54) CENTRAL PONTOON SEMISUBMERSIBLE FLOATING PLATFORM

(75) Inventors: Pieter G. Wybro, Houston, TX (US); Chunfa Wu, Missouri City, TX (US); Dagang Zhang, Houston, TX (US)

(73) Assignee: CPSP Ltd., Houston, TX (US)

( * ) Notice: Subject to any disclaimer, the term of this patent is extended or adjusted under 35 U.S.C. 154(b) by 0 days.

(21) Appl. No.: 10/858,120

(22) Filed: Jun. 1, 2004

(65) Prior Publication Data

US 2005/0120935 A1 Jun. 9, 2005

Related U.S. Application Data

(60) Provisional application No. 60/527,384, filed on Dec. 6, 2003.

(51) Int. Cl.
*B63B 35/44* (2006.01)

(52) U.S. Cl. ..... 114/264

(58) Field of Classification Search ..... 114/264, 114/265, 61.12, 61.14
See application file for complete search history.

(56) References Cited

U.S. PATENT DOCUMENTS 3,011,467 A * 12/1961 Letourneau ..... 114/265
3,163,147 A * 12/1964 Collipp ..... 114/265
4,498,412 A 2/1985 Liden
4,909,174 A * 3/1990 Bowes ..... 114/265
6,015,245 A 1/2000 Frimm et al.
6,447,208 B1 9/2002 Huang et al.
6,503,023 B1 1/2003 Huang et al.
6,701,861 B1 3/2004 Key et al.
2001/0026733 A1 10/2001 Ludwigson
2002/0025229 A1* 2/2002 Huang et al. ..... 405/204

* cited by examiner

*Primary Examiner*—Sherman Basinger
(74) *Attorney, Agent, or Firm*—Kenneth A. Roddy

(57) ABSTRACT

A central pontoon semisubmersible floating platform for use in offshore applications has a hull configuration including vertical support columns, a central pontoon structure disposed inboard of the columns at a lower end thereof, and a deck structure supported at an upper end of the columns. The vertical columns and pontoon structure are constructed substantially of flat plate. The vertical columns are adjoined to the outer periphery of the central pontoon and have a transverse cross sectional shape with a major axis oriented radially outward from a center point of the hull, and a central vertical axis disposed a distance outward from the pontoon outer periphery. Risers can be supported on the inboard or outboard side of the pontoon and extended to the deck, and the structure can be anchored by mooring lines extending along the outboard face of the columns extending radially outward and downward from their lower ends.

21 Claims, 11 Drawing Sheets

CENTRAL PONTOON SEMISUBMERSIBLE FLOATING PLATFORM

CROSS REFERENCE TO RELATED APPLICATION

This application claims priority of U.S. Provisional Application Ser. No. 60/527,384, filed Dec. 6, 2003.

BACKGROUND OF THE INVENTION

1. Field of the Invention

This invention relates generally to ring pontoon semisubmersible floating platforms, and more particularly to a central pontoon semisubmersible floating platform for use in offshore applications, such as for offshore oil and gas drilling and production, which has a hull with radially oriented columns and a central pontoon structure disposed inboard of the columns that simplifies construction, reduces support spans and cantilevers, and provides improved hydrodynamic performance of the platform.

2. Background Art

Semisubmersible vessels typically have a superstructure deck or decks supported by columns that are attached to hulls or pontoons, which have adjustable ballast capability. By adjusting the ballast carried by the pontoons, the pontoons may be positioned at or near the surface of the water or in a submerged location below the surface of the water, while the superstructure deck remains above the surface of the water. While being moved to a location where the vessel is to be used, the pontoons are typically are de-ballasted to permit them to ride at or near the surface of the water, facilitating transport of the vessel. After reaching the desired location, the ballast of the pontoons may be adjusted to cause the pontoons to become submerged below the surface of the water, providing improved stability and reduced motion of the vessel in rough, deep seas.

In conventional ring-pontoon semisubmersible vessels or platforms, the pontoons support the superstructure deck by columns which rise vertically or substantially vertically from the ring pontoon at various locations, as well as braces which may interconnect the pontoons, the pontoons and the columns, the columns and the superstructure, and/or two or more of the columns, to provide a strong and substantially rigid base structure that supports the deck(s) of the superstructure.

The interior of both the columns and the pontoons may be subdivided by bulkheads to strengthen the structure, to provide enclosed spaces for locating and storing various equipment (e.g., anchors, chains, propulsion mechanisms, etc.), possible storage of liquids such fuel and water, and product storage, and to provide a plurality of separate tanks for purposes of ballasting the vessel and storing various fluids and other materials which may be required or desired during drilling or produced by the well.

In a typical ring pontoon semisubmersible vessel or platform, the corner columns are placed such that the vertical centerline of the columns intersect the axial centerline of the pontoon on which the column is located.

Key et al, U.S. Pat. No. 6,701,861 discloses a semisubmersible floating production vessel which has a ring pontoon with three main columns extending upwardly from corners of the pontoon and three secondary, minor columns extending upwardly from centers of the triangle sides. The columns support an open frame deck, on which production modules are positioned. The vessel is adapted for semipermanent mooring with pre-tensioned mooring lines that are attached to swivel pad eyes secured on the main columns below the water line. Production and export risers are connected to the vessel below the water line. Compressed air ballast system allows selective emptying of ballast compartments located in the ring pontoon and eliminates the need for a conventional pump room.

Huang et al, U.S. Pat. No. 6,503,023 discloses temporary stability modules and a method for marine structures during construction, transportation and installation that permits the structure, including platform, deck and equipment to be constructed in an upright position, towed to an ocean installation site, and installed by ballasting the structure or temporary stability modules and subsequent removal of the modules. The removable temporary stability modules are shown attached to an "extended-base" "tension leg" platform having four rectangular support columns disposed about a central axis of the substructure and horizontal pontoons interconnecting adjacent columns at their lower ends. The substructure also includes leg extensions radiating from the columns and/or the pontoons, which are described more fully in U.S. Pat. No. 6,447,208, discussed below.

Huang et al, U.S. Pat. No. 6,447,208 discloses an "extended-base" "tension leg" substructure, an offshore platform supported on the substructure and a method for supporting an offshore platform on the substructure, where the substructure includes a plurality of support columns disposed about a central axis of the substructure and interconnected by at least one pontoon. Each column comprises an above-water and submerged portion. The substructure also includes a plurality of wings or arms radiating from the columns and/or the pontoons, each wing fixedly or removably securing at least one tendon extending from a wing to an anchor on the seabed. The substructure includes an open, wave transparent central zone for improved access to well-related equipment, conduits or the like and the wings minimize translational movement and rotational flex in the substructure reducing fatigue in the tendons and their connections.

It should be noted that the U.S. Pat. Nos. 6,503,023 and 6,447,208 are directed toward "extended-base" "tension leg platforms", which have vertical heave-restrained mooring, wherein the present invention is a semisubmersible structure with lateral spread mooring that is not heave restrained. The outwardly extending wings or extensions of the prior art "extended-base" structures support the tendons some distance outboard of the vertical columns, thus the mooring loads cause restraint against platform vertical and rotational motions. In the present invention, the mooring loads do not provide substantial vertical or rotational restraint, and the vertical columns, which are substantially outboard of the central pontoon, provide improved rotational stability.

Frimm et al, U.S. Pat. No. 6,015,245 discloses a ring pontoon semisubmersible offshore vessel wherein the vertical centerline of each of the corner columns is located inward of both the axial centerline of the forward section of the ring pontoon and the axial centerline of the aft section of the ring pontoon. Additionally, the vertical centerlines of the corner columns may be located inward with respect to the axial centerlines of the starboard and port portions of the ring pontoon. The superstructure deck may be supported by radial braces extending from the ring pontoon to locations on the superstructure deck, which are inward of the ring pontoon. Unlike the present invention, the pontoon structure is not substantially inboard of the columns.

Liden, U.S. Pat. No. 4,498,412 discloses a semi-submersible offshore platform having an operating deck carried by four cylindrical columns supported by a pontoon structure comprising four-sided boxes formed into a square ring. Each pontoon box is subdivided into two compartments by a longitudinal centerline bulkhead, the compartments being further subdivided into tanks by transverse bulkheads. Tanks outside the centerline bulkheads are used for ballast water, and tanks inside the centerline bulkheads are used to store the oil produced. Unlike the present invention, the pontoon structure is not substantially inboard of the columns.

Ludwigson, patent application 20010026733, published Oct. 4, 2001 discloses a semi-submersible vessel adapted to resist heave motion that includes a plurality of support columns with a square-shaped ring-pontoon connected to their lower ends. The axial centerline of the square-shaped ring-pontoon intersects the axial centerline of the lower ends of the support columns, and the support columns are inclined upwardly and inwardly from the ring-pontoon to the deck. Unlike the present invention, the pontoon structure is not substantially inboard of the columns.

The present invention is distinguished over the prior art in general, and these patents in particular by a central pontoon semisubmersible floating platform for use in offshore applications, such as for offshore oil and gas drilling and production, which has a hull configuration including vertical support columns, a central pontoon structure disposed inboard of the columns at a lower end thereof, and a deck structure supported at an upper end of the columns. The vertical columns and pontoon structure are constructed substantially of flat plate. The vertical columns are adjoined to the outer periphery of the central pontoon and have a transverse cross sectional shape with a major axis oriented radially outward from a center point of the hull, and a central vertical axis disposed a distance outward from the pontoon outer periphery. Risers can be supported on the inboard or outboard side of the pontoon and extended to the deck, and the structure can be anchored by mooring lines extending along the outboard face of the columns extending radially outward and downward from their lower ends. The central pontoon and outboard column structure simplifies construction, reduces support spans and cantilevers, and provides improved hydrodynamic performance of the platform.

SUMMARY OF THE INVENTION

It is therefore an object of the present invention to provide a central pontoon semisubmersible floating platform for use in offshore applications, such as for offshore oil and gas drilling and production, having a hull with radially oriented rectangular columns and a central pontoon structure disposed inboard of the columns that simplifies construction, reduces support spans and cantilevers, and provides improved hydrodynamic performance of the platform.

It is another object of this present invention to provide a central pontoon semisubmersible floating platform having a hull with radially oriented rectangular columns and a central pontoon structure disposed inboard of the columns which are formed substantially of flat plate construction, thus simplifying the construction of the structure.

Another object of this invention is to provide a central pontoon semisubmersible floating production platform having vertical columns of rectangular cross section that have major axis oriented radially outward from the center of the hull, which provide support for the deck and reduces the support spans and cantilevers of the deck structure required for deck support in conventional semisubmersible platforms.

Another object of this invention is to provide a central pontoon semisubmersible floating production platform having vertical columns of rectangular cross section that have major axis oriented radially outward from the center of the hull, wherein mooring loads do not cause substantial restraint against platform vertical and rotational motions, and the vertical columns, disposed substantially outboard of the central pontoon, provide improved rotational stability.

Another object of this invention is to provide a central pontoon semisubmersible floating production platform having a unitized central pontoon structure located inboard of the vertical columns that may have a central moonpool opening or may be completely enclosed, which improves the hydrodynamic performance of the platform as compared to conventional ring pontoon, is simpler construction, lighter in weight, and facilitates the support of steel catenary and flexible risers.

A further object of this present invention is to provide a central pontoon semisubmersible floating production platform having a hull with radially oriented rectangular columns and a central pontoon structure disposed inboard of the columns which allows the support of flexible risers on the inboard or the outboard side of the central pontoon structure that can be extended to the deck by a single span spool piece or by piping supported on the hull, and the support of near-vertical top tensioned risers on the deck or supported laterally at the pontoon elevation by riser keel joints.

A still further object of this present invention is to provide a central pontoon semisubmersible floating production platform having a hull with radially oriented rectangular columns and a central pontoon structure disposed inboard of the columns and ballasting and de-ballasting apparatus in the columns that eliminates the need for below water hull penetrations and sea chests Other objects of the invention will become apparent from time to time throughout the specification and claims as hereinafter related.

The above noted objects and other objects of the invention are accomplished by a central pontoon semisubmersible floating platform for use in offshore applications, such as for offshore oil and gas drilling and production, which has a hull configuration including vertical support columns, a central pontoon structure disposed inboard of the columns at a lower end thereof, and a deck structure supported at an upper end of the columns. The vertical columns and pontoon structure are constructed substantially of flat plate. The vertical columns are adjoined to the outer periphery of the central pontoon and have a transverse cross sectional shape with a major axis oriented radially outward from a center point of the hull, and a central vertical axis disposed a distance outward from the pontoon outer periphery. Risers can be supported on the inboard or outboard side of the pontoon and extended to the deck, and the structure can be anchored by mooring lines extending along the outboard face of the columns extending radially outward and downward from their lower ends. The central pontoon and outboard column structure simplifies construction, reduces support spans and cantilevers, and provides improved hydrodynamic performance of the platform.

DESCRIPTION OF THE PREFERRED EMBODIMENTS

Figure 1:
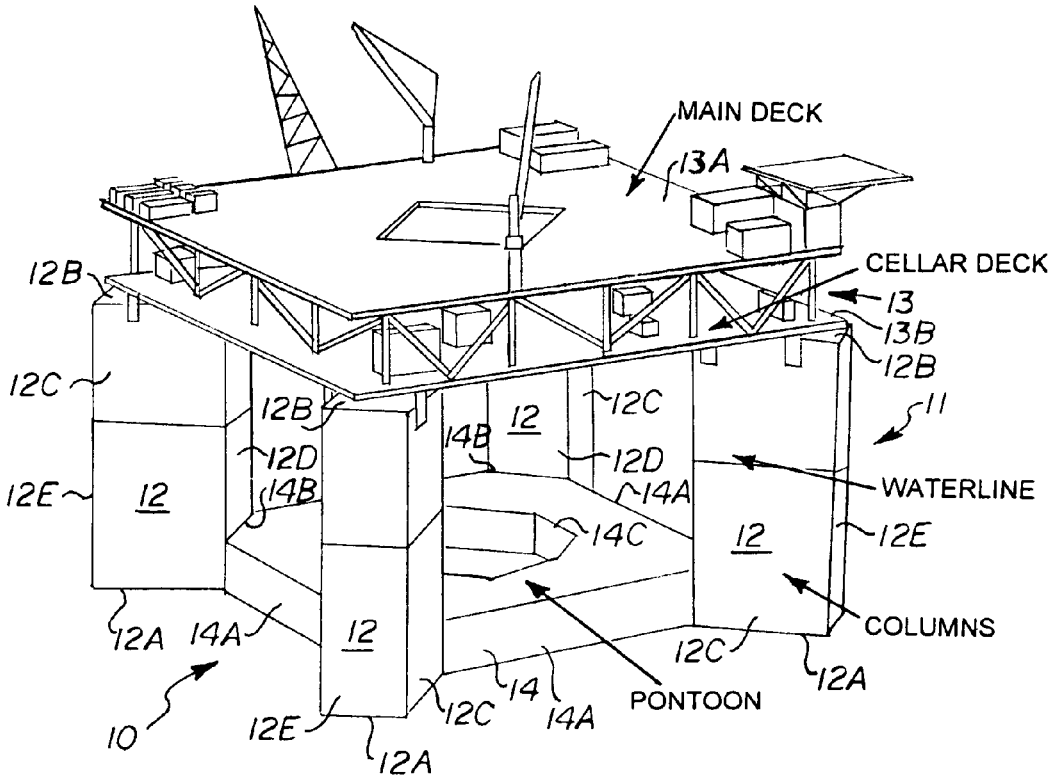
FIG. 1 is a perspective view of the central pontoon semisubmersible floating platform in accordance with the present invention.
Figure 2:
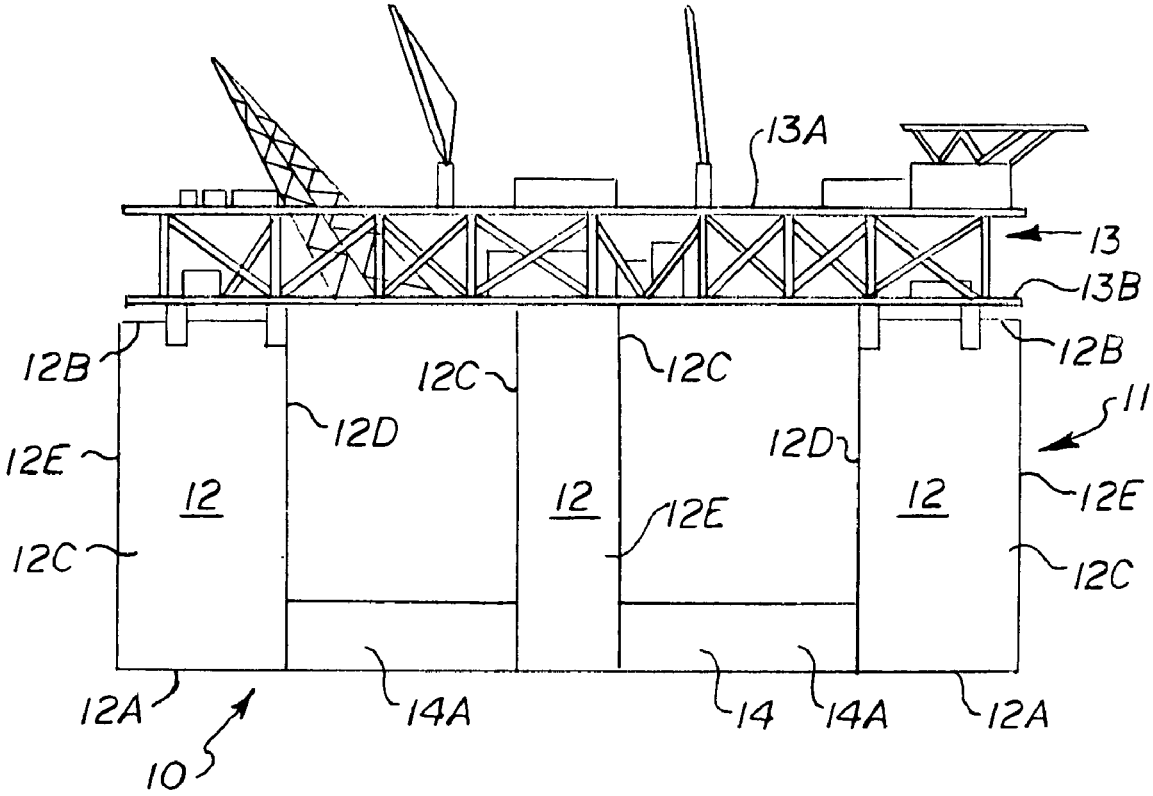
FIGS. 2 and 3 are a side elevation view and a perspective view, respectively, of the central pontoon semisubmersible floating platform.
Figure 3:
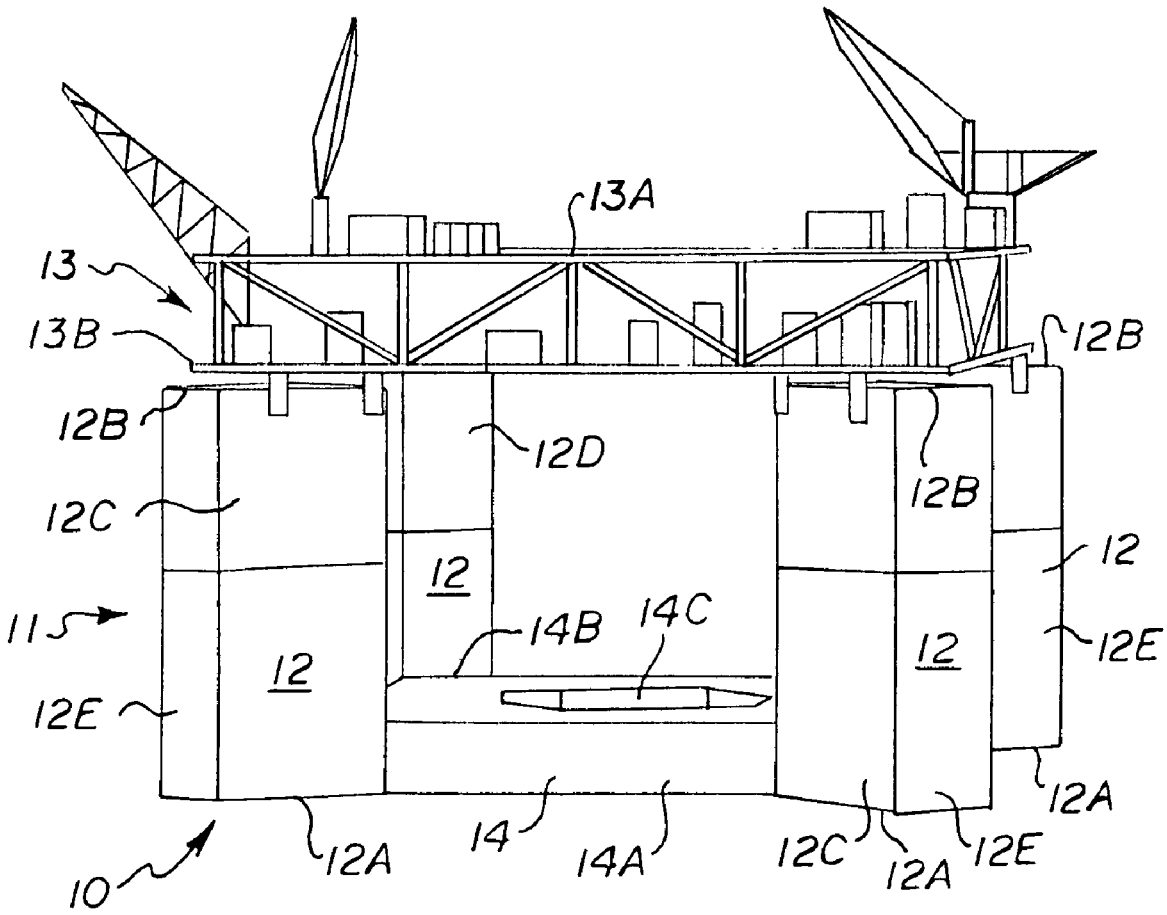

Referring to the drawings by numerals of reference, there is shown a preferred central pontoon semisubmersible floating platform 10 for use in offshore applications, such as for offshore oil and gas drilling and production. The platform 10 has a hull 11 configuration including vertical support columns 12 having a transverse cross sectional shape with a major axis oriented radially outward from a center point of the hull, a deck structure 13 supported at an upper end of the columns, and a central pontoon structure 14 disposed inboard of the columns at a lower end thereof. The columns 12 have a quadrilateral transverse cross section, which may be a generally rectangular or trapezoidal shaped configuration. The columns 12 and pontoon 14 are constructed substantially of flat metal plate, with the possible exception of local corners that may be provided with either simple radius curves or sharp corners. This feature simplifies the hull construction.

The central pontoon structure 14 is a generally octagonal-shaped configuration having four parallel spaced side portions 14A and four diagonally opposed corner portions 14B interconnected to form a unitized structure surrounding a central vertical axis. In the embodiment shown in FIGS. 1–5, the central pontoon structure 14 has a central moonpool opening 14C, which may be an octagonal opening or other suitable configuration, and the pontoon structure has a side wall of generally rectangular transverse cross section surrounding a central horizontal axis or horizontal centerline "HC" extending through the pontoon segments. Alternatively, the center of the pontoon structure may be completely enclosed In the embodiment illustrated in FIGS. 1–6, 7 and 8, each of the vertical support columns 12 has a lower end 12A and an upper end 12B, and a rectangular transverse cross section formed of two parallel spaced wider lateral side walls 12C interconnected with a narrower inboard side wall 12D and a parallel spaced outboard side wall 12E of substantially equal width. Thus, each vertical support column 12 has a major axis A1 extending between the inboard and outboard side walls 12D and 12E, and a minor axis A2 extending between the lateral side walls 12C. Each vertical support column 12 has a vertical longitudinal axis or vertical centerline "VC".

Figure 5:
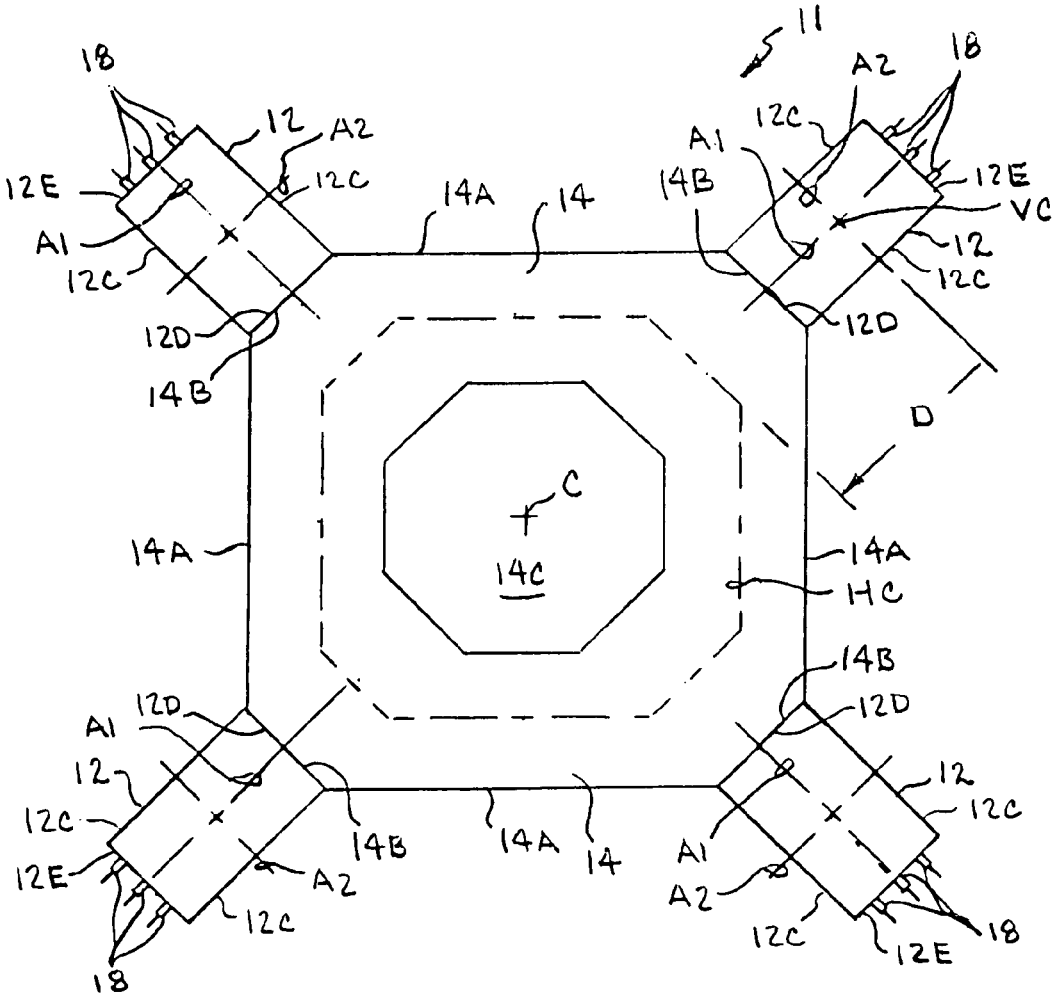
FIG. 5 is a top plan view of the pontoon and column hull structure of the central pontoon semisubmersible floating platform.

The lower portion of the narrower inboard side wall 12D of each vertical support column 12 is adjoined to a respective diagonal corner portion 14B the pontoon structure 14 and the opposed outboard side wall 12E is disposed radially outward therefrom. The major axis A1 of each of the vertical support columns 12 is oriented radially outward from the center "C" of the structure, as illustrated in FIG. 5. The vertical longitudinal axis or vertical centerline "VC" of each column 12 is disposed a distance outward from the outer periphery of the pontoon structure 14.

As illustrated in FIG. 5, the rectangular or trapezoidal vertical support columns 12, 112, are disposed substantially outboard of the central pontoon structure 14 with their major axis A1 oriented radially outward from the center "C" of the structure. The vertical longitudinal axis or vertical centerline "VC" of each column 12 is disposed a distance outward from the outer periphery of the pontoon structure 14 and, with pontoon structures having a central opening, a distance D outwardly from the central horizontal axis or horizontal centerline "HC" extending through the pontoon segments. Thus, with the hull configuration of the present invention, the central pontoon structure 14 is positioned inboard of the vertical support columns 12, and the vertical longitudinal axis or vertical centerline "VC" of each column 12 does not intersect the outer periphery of the pontoon structure 14, and does not intersect the axial (horizontal) centerline HC of the pontoon segments. This feature differs from conventional floating production semisubmersible platform designs, which typically have the ring pontoons positioned between the columns, with the axial (vertical) centerline of the support columns intersecting the axial centerline of the ring-pontoon segments.

The interior of both the columns and the pontoons may be subdivided by bulkheads to strengthen the structure, to provide enclosed spaces for locating and storing various equipment (e.g., anchors, chains, propulsion mechanisms, etc.), and to provide a plurality of separate tanks for purposes of ballasting the vessel and storing various fluids and other materials which may be required or desired during drilling or production by the well.

Figure 6:
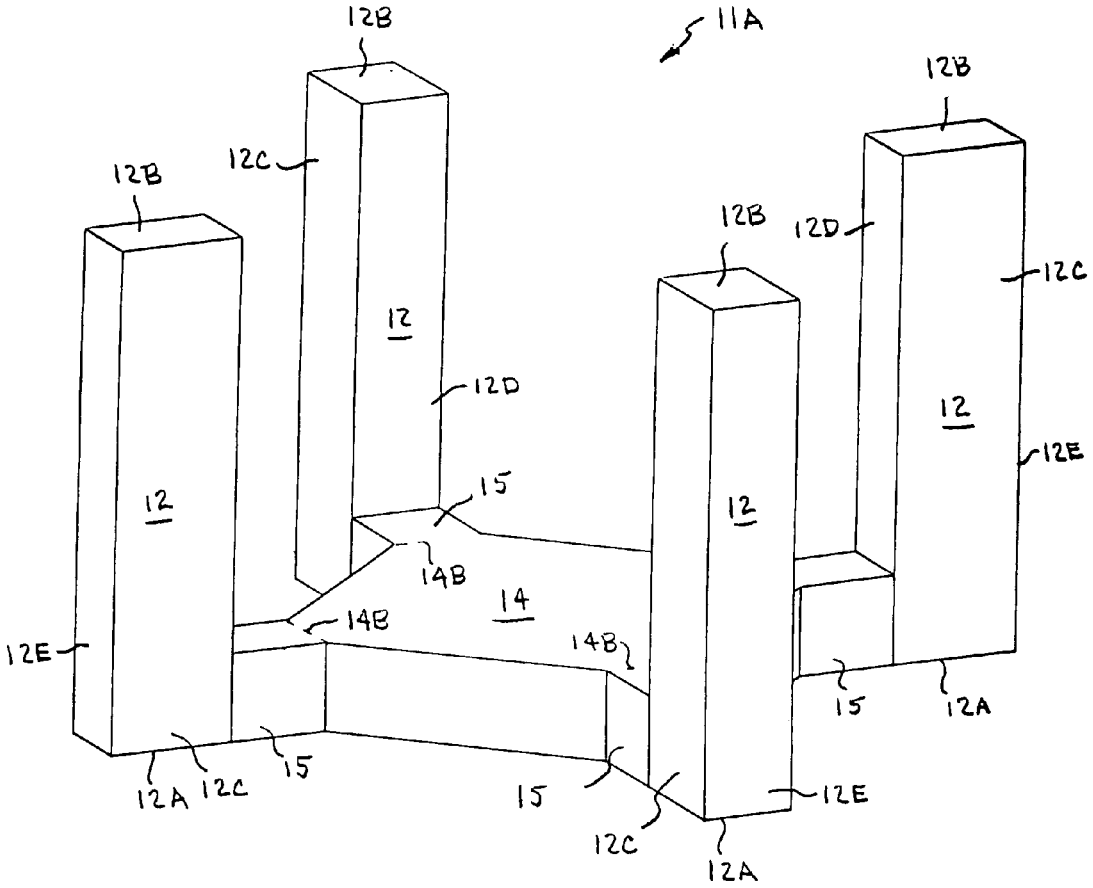
FIG. 6 is a perspective view showing modifications of the hull structure wherein the central pontoon structure does not have a central opening and is located a greater distance inboard of the columns and adjoined to the columns by rectangular extensions.

FIG. 6 shows, somewhat schematically, a modification of the hull 11A having a central pontoon structure 14 located inboard of the columns 12, wherein the pontoon structure does not have a central opening. FIG. 6 also shows an alternate embodiment of the hull structure wherein the outer periphery of the pontoon structure is spaced a greater distance radially inward from the vertical support columns 12 (closer to the center "C" of the structure). In this embodiment, the lower portion of the inboard side wall 13D of each vertical support column 12 is adjoined to the diagonal corner portions 14B of the pontoon structure 14 by a rectangular extension 15 secured between the pontoon corner portions and inboard side wall of the column to form a unitized structure.

Figure 6A:
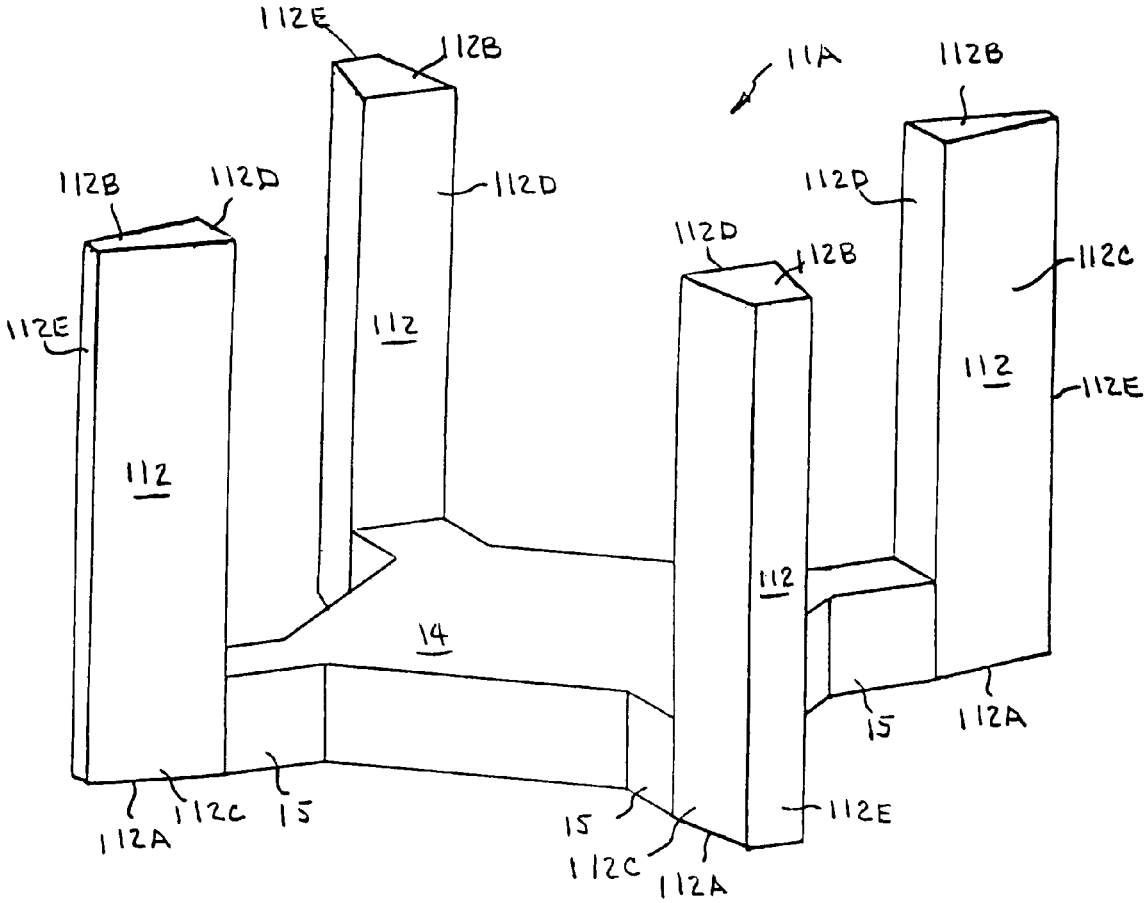
FIG. 6A is a perspective view similar to FIG. 6 showing an alternate embodiment of the vertical support columns wherein the columns have a generally trapezoidal transverse cross section with a wider inboard side wall and a narrower outboard side wall.

FIG. 6A shows, somewhat schematically, an alternate embodiment of the vertical support columns 112 wherein each of the columns has a lower end 112A and an upper end 112B, and a generally trapezoidal transverse cross section with a wider inboard side wall 112D and a narrower outboard side wall 112E interconnected in parallel spaced relation by two nonparallel laterally spaced side walls 112C.

Placing the central pontoon structure 14 radially inboard of the vertical support columns 12 improves the hydrodynamic performance of the platform, reduces support spans and cantilevers, reduces the vertical motion of the attachment point of the risers, and facilitates the support of steel catenary and flexible risers.

Figure 4:
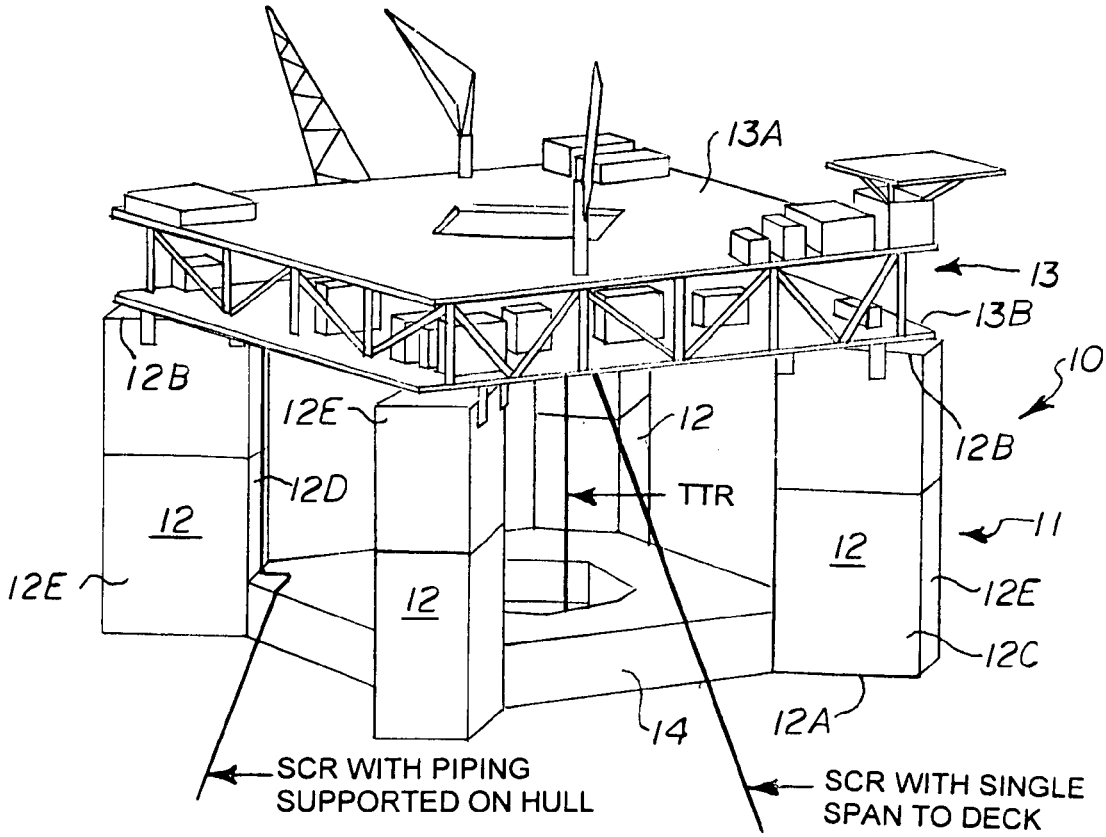
FIGS. 4 and 4A are perspective view of the central pontoon semisubmersible floating platform, showing various types of risers that can be supported by the hull on the inboard or the outboard side of the central pontoon structure, and mooring lines supported on the outboard side of the vertical columns.
Figure 4A:
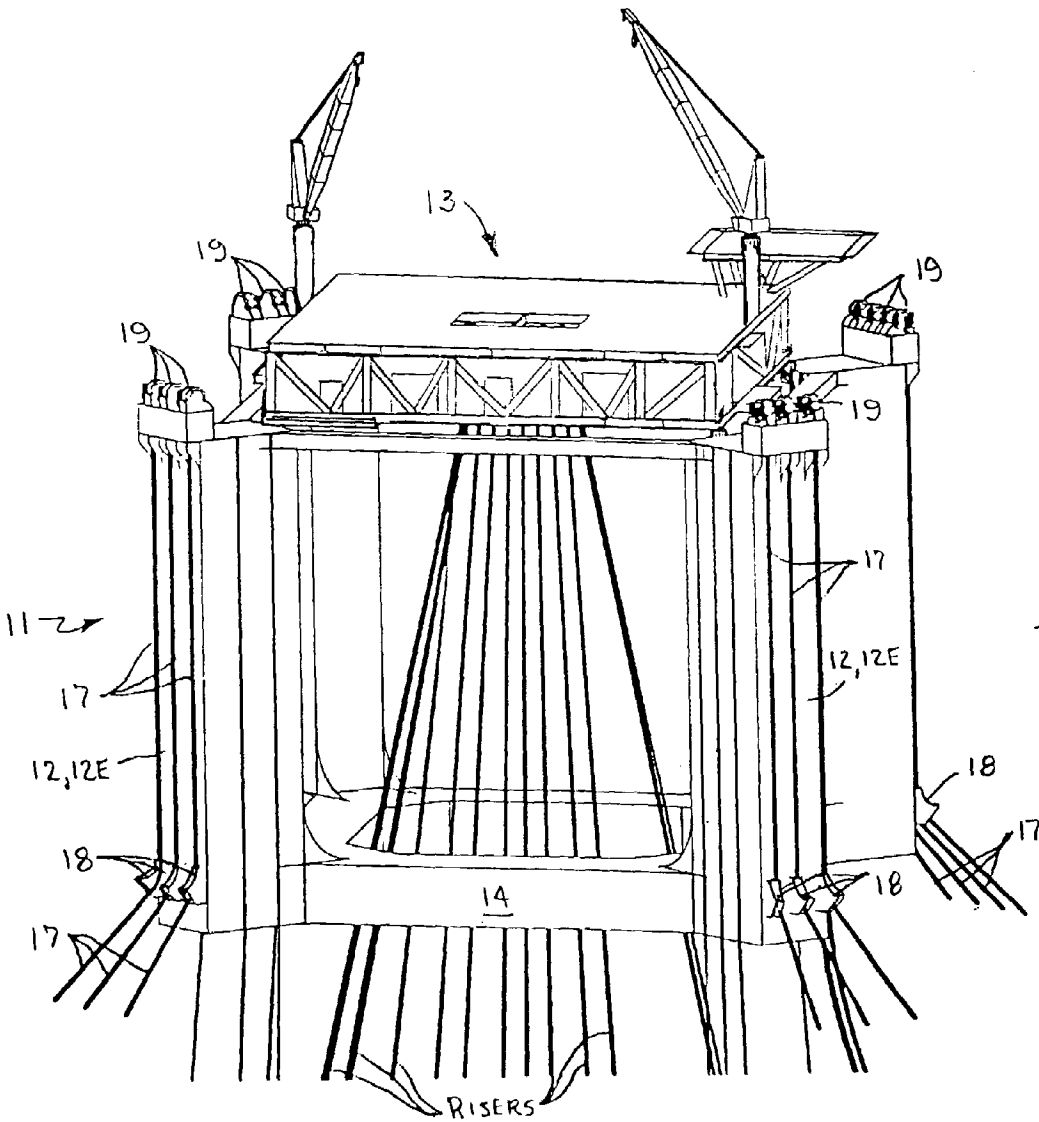

As shown in FIGS. 4 and 4A, various types of risers can be supported by the hull, including near-vertical top tensioned risers (TTR), flexible risers, or steel catenary risers (SCR). The flexible risers or steel catenary risers (SCRs) can be supported on the inboard or the outboard side of the central pontoon structure 14, and extended to the deck 13 by either a single span spool piece or by piping supported on the hull. The top tensioned risers (TTRs) can be supported on the deck, and can also be supported laterally at the pontoon elevation by riser keel joints.

The structure may be anchored by a plurality of mooring lines 17 extending through fairleads 18 on the lower end of the outboard face of the columns 12 with the upper ends of the lines extending upwardly along the outer side wall 12E of the columns generally parallel with their longitudinal axis to mooring winches 19 on the deck 13 and their lower ends extending radially outward and downward from the fairleads and anchored to the seabead. With the present mooring system, the mooring loads do not cause substantial restraint against the vertical and rotational motions of the platform, and the vertical columns, disposed substantially outboard of the central pontoon, provide improved rotational stability that can be encountered with changes in the direction of wind, wave and currents.

Figure 7:
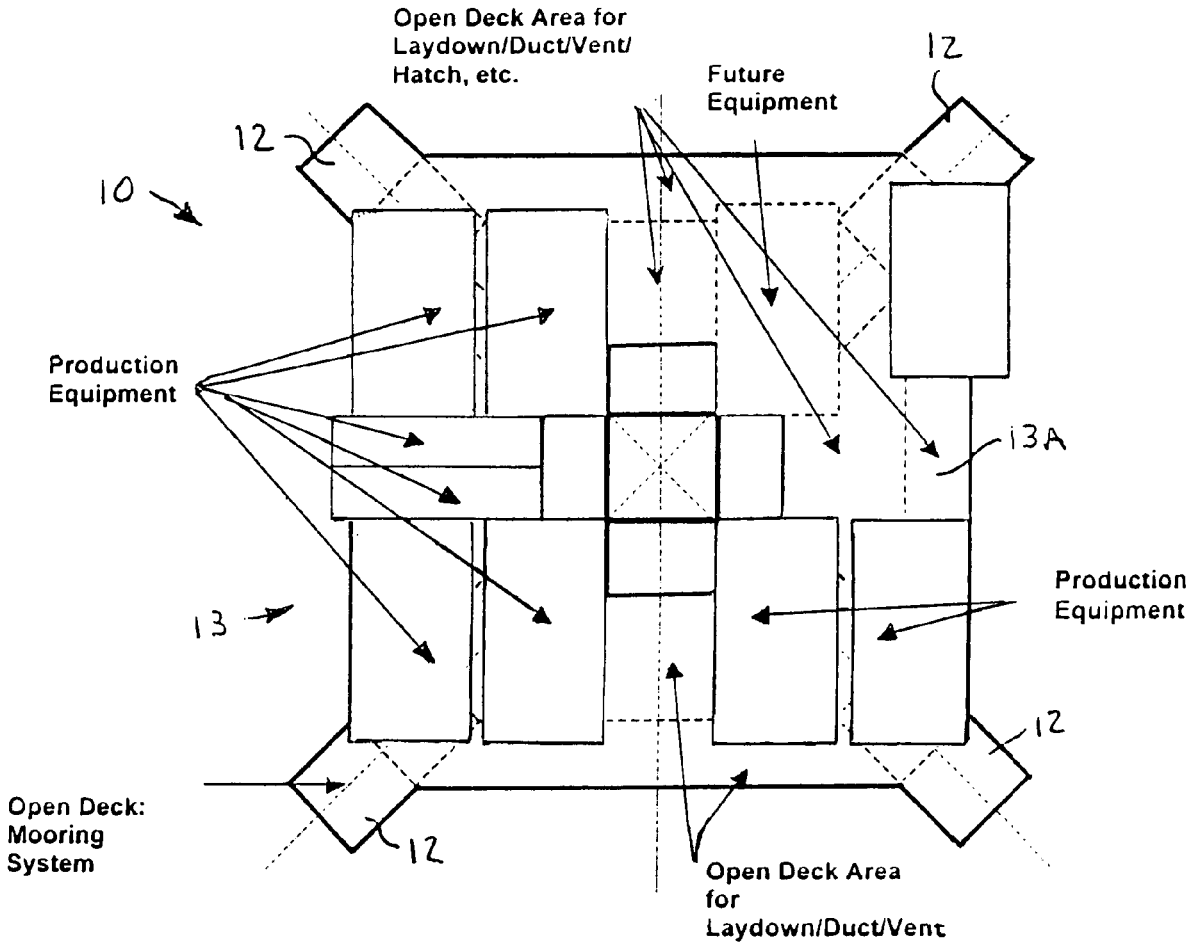
FIGS. 7 and 8, respectively, are top plan views of upper main deck and a lower cellar deck which may be supported at the top of the hull structure of the present central pontoon semisubmersible floating platform.
Figure 8:
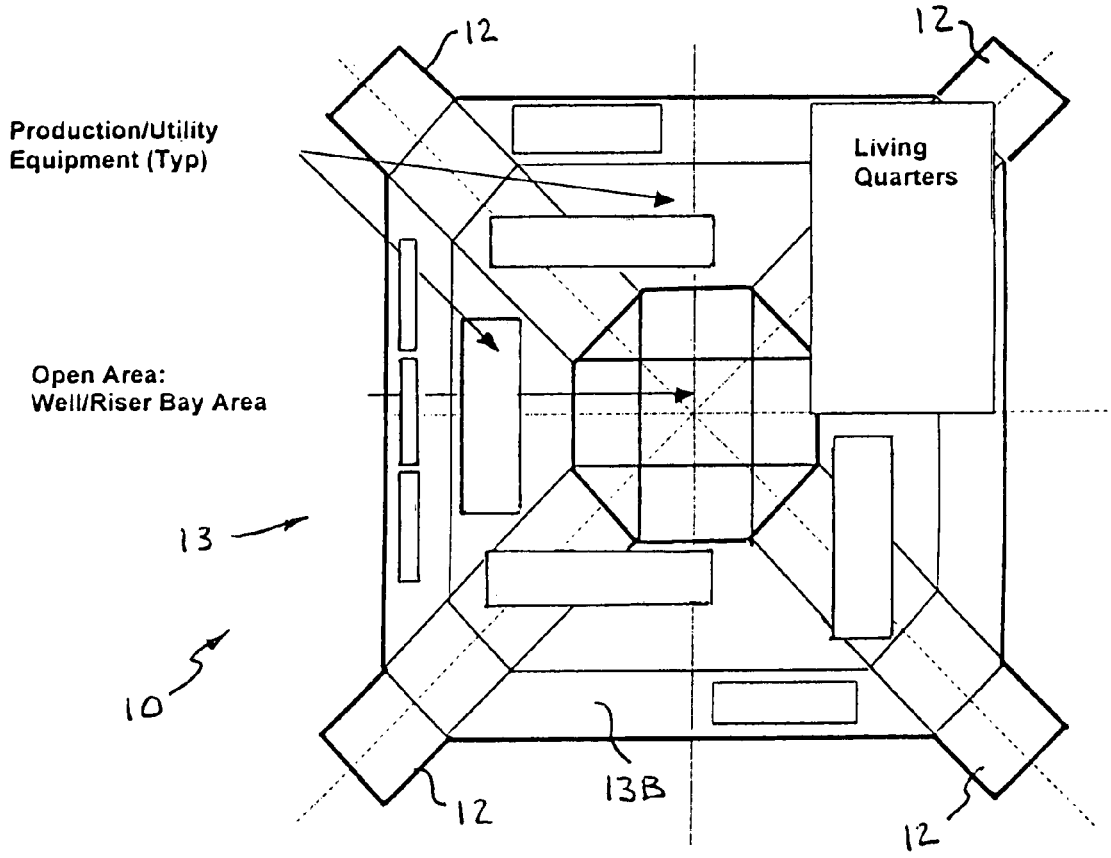

Various deck arrangements may be supported above at the top of the hull 11 of the present invention, for example a deck having an upper main deck 13A and a lower cellar deck 13B. FIG. 7 is a top plan view showing a typical layout of a main deck 13A, and FIG. 8 is a top plan view showing a typical layout of a cellar deck 13B. In this example, but not limited thereto, the main deck 13A accommodates storage space for machinery and production equipment, laydown areas, and the cellar deck 13B holds living quarters and storage space for machinery and production equipment. Drilling operations may be carried out through a moonpool opening in the cellar deck and main deck.

Figure 9:
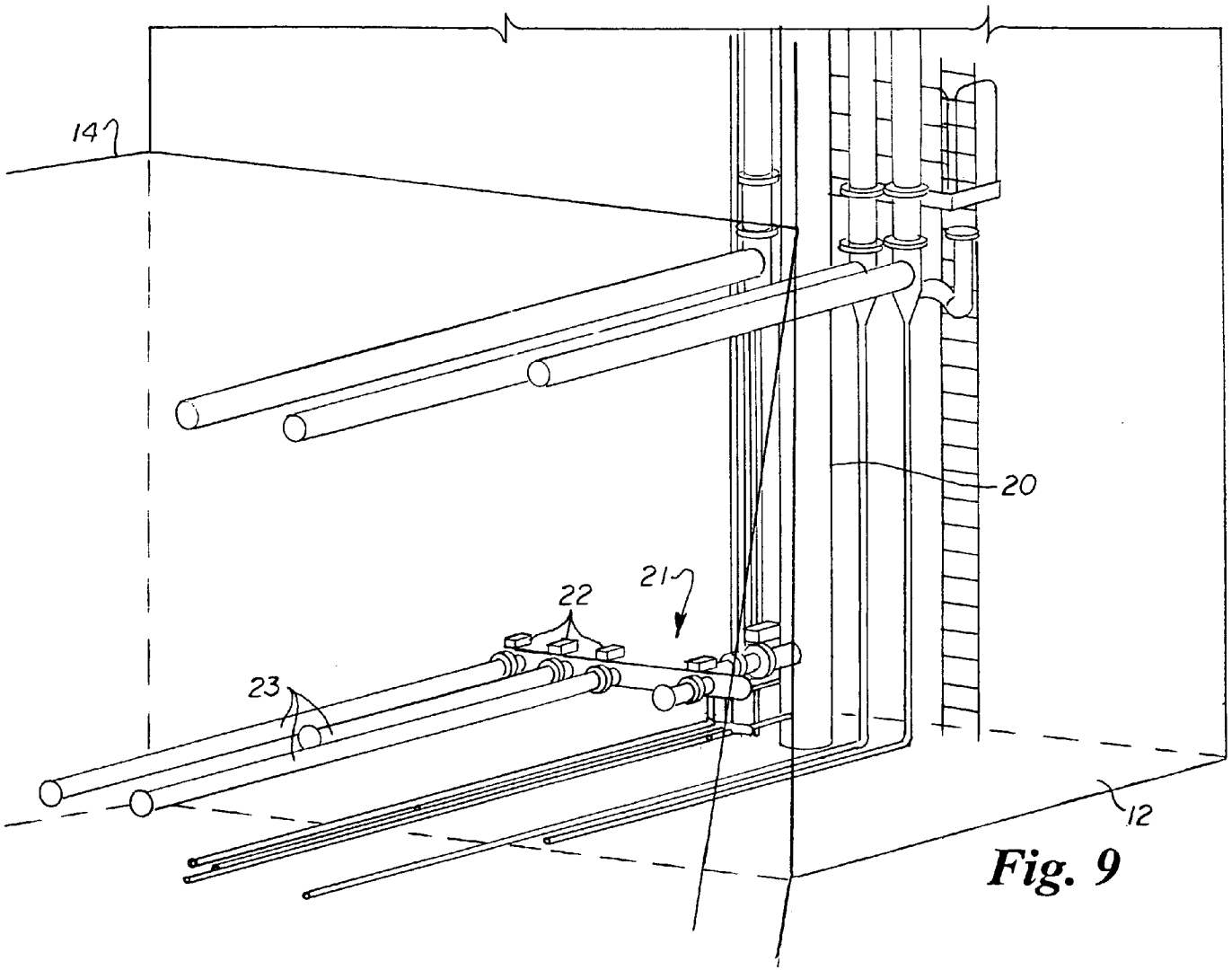
FIG. 9 is a partial perspective view, showing somewhat schematically, a system of apparatus in a column for ballasting and de-ballasting the hull.

As shown somewhat schematically in FIG. 9, ballasting the hull 11 may be accomplished by means of topsides pumps (firewater or seawater services) tied into a caisson 20 located inside the columns 12. The base of the caisson 20 is supported at the bottom portion of the column 12 and is tied to a manifold 21 with valves 22 and piping 23 to each compartment and tank. De-ballasting is accomplished by a submersible pump (not shown) disposed inside the caisson 20, with a pipe discharging overboard at or near the top of column. This ballasting and de-ballasting system is simple and cost effective, and eliminates the requirement for below water hull penetrations and sea chests.

While this invention has been described fully and completely with special emphasis upon preferred embodiments, it should be understood that within the scope of the appended claims the invention may be practiced otherwise than as specifically described herein.

The invention claimed is:

1. A semisubmersible floating platform for use in offshore applications, comprising:

a hull including vertical support columns, a pontoon structure disposed inboard of said vertical support columns and adjoined to said columns at a lower end thereof, and a deck structure supported at an upper end of said columns;

each of said vertical support columns having a transverse cross sectional shape with a horizontal major axis oriented radially outward from a center point of said hull; and station keeping means connected with said vertical support columns for maintaining said platform above a desired subsea location without substantial restraint against platform vertical and rotational motions such that said platform is not heave-restrained.

2. The semisubmersible floating platform according to claim 1, wherein said columns and said pontoon structure is constructed substantially of flat plate.

3. The semisubmersible floating platform according to claim 1, wherein each of said columns has a polygonal transverse cross section.

4. The semisubmersible floating platform according to claim 1, wherein each of said columns has a quadrilateral transverse cross section.

5. The semisubmersible floating platform according to claim 4, wherein each of said columns has a generally trapezoidal transverse cross section formed of a wider inboard side wall and a narrower outboard side wall interconnected in parallel spaced relation by two nonparallel laterally spaced side walls, and its said horizontal major axis extending between said inboard and outboard side walls.

6. The semisubmersible floating platform according to claim 4, wherein each of said columns has a generally rectangular transverse cross section formed of an inboard side wall and an outboard side wall of substantially equal width interconnected in parallel spaced relation by two parallel laterally spaced side walls of greater width than said inboard and outboard side walls, and its said horizontal major axis extending between said inboard and outboard side walls.

7. The semisubmersible floating platform according to claim 1, wherein said pontoon structure is a generally octagonal-shaped configuration having four parallel spaced sides and four diagonally opposed corner portions interconnected to form a unitized structure; and each of said vertical support columns is adjoined to a respective said corner portion of said pontoon structure with its said horizontal major axis oriented radially outward therefrom.

8. The semisubmersible floating platform according to claim 7, wherein each of said vertical support columns is adjoined to a respective said corner portion of said pontoon structure by an extension member secured between said corner portion and a lower portion of said column to form a unitized structure.

9. The semisubmersible floating platform according to claim 1, wherein said pontoon structure is a generally octagonal-shaped configuration having four parallel spaced side segments and four diagonally opposed corner segments interconnected to form a unitized structure surrounding a central opening; and each of said vertical support columns is adjoined to a respective said corner segment of said pontoon structure with is said horizontal major axis oriented radially outward therefrom.

10. The semisubmersible floating platform according to claim 9, wherein said central pontoon structure side segments and corner segments are generally rectangular in transverse cross section.

11. The semisubmersible floating platform according to claim 9, wherein each of said vertical support columns is adjoined to a respective said corner portion of said pontoon structure by an extension member secured between said corner segment of said pontoon structure and a lower portion of said column to form a unitized structure.

12. The semisubmersible floating platform according to claim 1, further comprising:

ballasting and de-ballasting means in at least one of said vertical support columns in fluid communication with the interior of said pontoon structure and with the exterior of said column including fluid receiving means having a fluid inlet at an upper end of said column adapted for connection to a pressurized water source above the sea level for conducting water into said central pontoon structure, pump means at a lower end of said column for conducting water out of said pontoon structure, and fluid discharge means connected with said pump means for discharging the water overboard near said upper end of said column.

13. A semisubmersible floating platform for use in offshore applications, comprising:

a hull including a pontoon structure having an outer periphery surrounding a central vertical axis, vertical support columns each adjoined at a lower end to said pontoon structure outer periphery, and a deck structure supported at an upper end of said columns;

said pontoon structure disposed inboard of said vertical support columns, and each of said vertical support columns having a central vertical longitudinal axis disposed a distance radially outward from said outer periphery of said pontoon structure; and station keeping means connected with said vertical support columns for maintaining said platform above a desired subsea location without substantial restraint against platform vertical and rotational motions such that said platform is not heave-restrained.

14. The semisubmersible floating platform according to claim 13, wherein each of said vertical support columns has a transverse cross sectional shape with a horizontal major axis oriented radially outward from said central vertical axis of said pontoon structure.

15. The semisubmersible floating platform according to claim 14, wherein said pontoon structure surrounds a central opening and has a side wall of generally polygonal transverse cross section surrounding a central horizontal axis; and each of said vertical support columns is adjoined to said pontoon side wall with its said horizontal major axis extending radially outward therefrom, and its said central vertical longitudinal axis disposed a sufficient distance outwardly from said central pontoon structure central horizontal axis so as not to intersect therewith.

16. The semisubmersible floating platform according to claim 14, wherein each of said columns has a polygonal transverse cross section.

17. The semisubmersible floating platform according to claim 14, wherein each of said columns has a quadrilateral transverse cross section.

18. The semisubmersible floating platform according to claim 17, wherein each of said columns has a generally trapezoidal transverse cross section formed of a wider inboard side wall and a narrower outboard side wall interconnected in parallel spaced relation by two nonparallel laterally spaced side walls, and its said horizontal major axis extending between said inboard and outboard side walls.

19. The semisubmersible floating platform according to claim 17, wherein each of said columns has a generally rectangular transverse cross section formed of an inboard side wall and an outboard side wall of substantially equal width interconnected in parallel spaced relation by two parallel laterally spaced side walls of greater width than said inboard and outboard side walls, and its said horizontal major axis extending between said inboard and outboard side walls.

20. A semisubmersible floating platform for use in offshore applications, comprising:

a hull including a ring pontoon structure surrounding a central opening and having a side wall which, in transverse cross section, surrounds a horizontal axial center line, vertical support columns each adjoined at a lower end to an outboard side of said pontoon structure side wall, and a deck structure supported at an upper end of said columns;

said pontoon structure disposed inboard of said vertical support columns, and each of said vertical support columns having a central vertical longitudinal axis disposed a distance radially outward from said horizontal axial center line of said pontoon structure so as not to intersect therewith; and station keeping means connected with said vertical support columns for maintaining said platform above a desired subsea location without substantial restraint against platform vertical and rotational motions such that said platform is not heave-restrained.

21. The semisubmersible floating platform according to claim 20, wherein said station keeping means is a laterally spread mooring system comprising a plurality of mooring lines having upper portions extending downwardly from mooring winches on said deck, along an outer side wall of said columns, through fairleads at lower ends of the outer side wall, and lower portions extending radially outward and downward from said fairleads and anchored to the seabed.

* * * * *